US007420142B2

(12) United States Patent
Barrena et al.

(10) Patent No.: US 7,420,142 B2
(45) **Date of Patent: *Sep. 2, 2008**

(54) POWER CONTROL MODULE FOR ELECTRICAL APPLIANCES

(75) Inventors: Juan Barrena, Johnston, RI (US); Eric K. Larson, Cumberland, RI (US); David Gill, North Providence, RI (US)

(73) Assignee: Illinois Tool Works, Inc, Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/548,396

(22) Filed: Oct. 11, 2006

(65) Prior Publication Data

US 2007/0178728 A1 Aug. 2, 2007

Related U.S. Application Data

(63) Continuation-in-part of application No. 11/242,629, filed on Oct. 3, 2005, now Pat. No. 7,304,274, which is a continuation of application No. 10/206,885, filed on Jul. 26, 2002, now Pat. No. 6,951,997.

(51) Int. Cl.
*H05B 3/68* (2006.01)
*H05B 1/02* (2006.01)

(52) U.S. Cl. ..... 219/501; 219/448.11

(58) Field of Classification Search ..... 219/476–495, 219/447.1–448.13, 519; 337/10, 11; 361/160–172
See application file for complete search history.

(56) References Cited

U.S. PATENT DOCUMENTS 3,169,176 A 2/1965 Fisher (Continued)

FOREIGN PATENT DOCUMENTS

EP 0 372 462 5/1989

(Continued)

OTHER PUBLICATIONS

Roland, E.T. & Patti, R.D. "Computer Aapplication in Appliance Testing," IEEE Transactions on Industry Applications, vol. 1A-11, No. 5, pp. 560-563 Sep.-Oct. 1975.

(Continued)

*Primary Examiner*—Sang Y Paik
(74) *Attorney, Agent, or Firm*—Boyle Fredrickson, S.C.

(57) ABSTRACT

A power module to regulate delivery of power to one or more loads is disclosed. The module includes a logic circuit configured to generate one or more control signals indicative of the power level to be applied from an external power supply coupled to the power module to the one or more loads, an electromechanical device configured to electrically connect the external power supply to the one or more loads based on the one or more control signals from the logic circuit, a user-controlled circuit configured to provide a signal indicative of a power level to deliver to the one or more loads, the signal is based on input received from a user-controlled actuator configured to be placed in one of a plurality of positions corresponding to user-provided input, and a housing configured to receive the electromechanical device.

30 Claims, 12 Drawing Sheets

U.S. PATENT DOCUMENTS

| | | | | |
|---|---|---|---|---|
| 3,388,236 | A | 6/1968 | Holtkamp | |
| 3,474,227 | A | 10/1969 | Gambill | |
| 3,612,826 | A | 10/1971 | Deaton et al. | |
| 3,665,159 | A | 5/1972 | Becker et al. | |
| 3,699,307 | A | 10/1972 | Malkin | |
| 3,852,558 | A | 12/1974 | McCleerey et al. | |
| 4,017,702 | A | 4/1977 | Harmon et al. | 219/715 |
| 4,052,591 | A | 10/1977 | Sekera et al. | |
| 4,088,984 | A | 5/1978 | Muramoto et al. | |
| 4,237,368 | A | 12/1980 | Welch | |
| 4,370,692 | A | 1/1983 | Wellman et al. | |
| 4,431,907 | A | 2/1984 | Barnett | 219/448.11 |
| 4,527,049 | A | 7/1985 | Thomas et al. | 219/446.1 |
| 4,568,927 | A * | 2/1986 | Fowler | 345/184 |
| 4,591,781 | A | 5/1986 | Larson | |
| 4,604,518 | A | 8/1986 | Payne | |
| 4,675,478 | A | 6/1987 | Song | |
| 4,896,004 | A | 1/1990 | Aframian | |
| 4,973,933 | A | 11/1990 | Kadlubowski | |
| 5,040,089 | A * | 8/1991 | Sasaki | 361/160 |
| 5,079,410 | A | 1/1992 | Payne et al. | |
| 5,191,310 | A | 3/1993 | Obermann et al. | |
| 5,392,021 | A * | 2/1995 | Liao | 340/572.5 |
| 5,844,207 | A | 12/1998 | Allard et al. | |
| 6,057,529 | A | 5/2000 | Kirby | |
| 6,111,231 | A | 8/2000 | Corson et al. | |
| 6,166,353 | A | 12/2000 | Senneville et al. | |
| 6,232,582 | B1 | 5/2001 | Minnear et al. | |
| 6,262,378 | B1 * | 7/2001 | Chou | 200/4 |
| 6,271,506 | B1 | 8/2001 | Glaser | |
| 6,951,997 | B2 * | 10/2005 | Larson et al. | 219/492 |

FOREIGN PATENT DOCUMENTS

| | | |
|---|---|---|
| JP | 55-65832 | 5/1980 |
| JP | 55-65833 | 5/1980 |
| JP | 55-65834 | 5/1980 |
| JP | 55-65835 | 5/1980 |
| JP | 59-56622 | 4/1984 |
| NZ | 214654 | 4/1989 |
| NZ | 230126 | 4/1993 |
| WO | WO91/13526 | 9/1991 |
| WO | WO98/24104 | 6/1998 |

OTHER PUBLICATIONS

Marx, E. "Infinitely Variable Control of Small Gas Burners" Warmed Gas Intl, vol. 33, No. 2-3, pp. 59-62, 1984.
Anonymous "Innovative Superheated Steam Production: new Superheated Model for Single and Double Flame and Smoke Tube Boilers" Brennstoff Waerme Kraft, vol. 50, No. 11/12, pp. 22-28, 1998.
Krischausky, L. "Development of an Extremely Nitro-oxide Poor Modulating Gas-burning Boiler" Zeitschrift fuer Heizung, Leuftung, Limatechnik, Haustechnik, vol. 46m No. 3, pp. 122-124, 1995.
Kaphahn, W. Air Feed Systems in Stenter Dryers International Dyer, vol. 180, No. 2, pp. 10-13, 1995.
Bagarry, J.N. "Three-channel Kiln Burner for Solid Fuels" World Chem, vol. 14, No. 1, pp. 36, 38, Jan. 1983.
"Foiling Machine" Boxboard Containers, pp. 53, Dec. 1975.
Babyak, R.J. "Tabletop Cooking" Appliance Manufacturer, vol. 45, No. 2, pp. 65-67, Feb. 1997.
Anonymous, "More Halogen Power" Appliance Manufacturer, vol. 44, No. 2, pp. 89-90 Feb. 1986.
McKenzie, M.D. "Selling on Smooth Looks and Easy Care" Dealerscope Merchandising, vol. 37, No. 1, pp. 126, Jan. 1995.
McKenzie, M.D. "Fit for a Chef" Dealerscope Merchandising, Vo 36, No. 11. pp. 68, Nov. 1994.
Anonymous "Major Appliance Merchandising" Dealerscope Merchandising, vol. 36, No. 10, pp. 60-62, Oct. 1994.
Meier K. "PTC Thermistor Heating Elements" Appliance vol. 58, No. 11, pp. 64(3), Nov. 2001.
"Control Products" Appliance, vol. 58, No. 9, pp. 116, Sep. 2001.
"Electric Charbroilers" Restaurants & Institutions, vol. 111, No. 18, pp. 116, Aug. 2001.
"Build Your Business with Zoning" Contracting Business, vol. 57, No. 7, pp. QHCA9, Jul. 2000.
"Frigidaire: Biggest Upscale Product Launch Due" HFD—The weekly Home Furnishings newspaper, pp. 89, Feb. 1993.
"Heater Sales Cool Off" HFD—The Weekly Home Furnishings Newspaper, pp. 64, Jan. 1993.
"GE Profile Series at Top of Line" HFD—The Weekly Home Furnishings Newspaper, pp. 158, May 1992.
"Typhoons Yield a Better Malt Whiskey" Process Engineering, pp. 23, May 1992.
"Kitchen Stovetop Equipment: What a Wide Range of Choices" Nationals Restaurant News, pp. 50, Apr. 1992.
"Large-Surface Lab Hot Plates" Metallurgic, pp. 167, Apr. 1992.
"More Cooktops Choices in Jenn-Air Debuts" HFD—The Weekly Home Furnishings Newspaper, pp. 100, Feb. 1992.
"Testing: Automatic Capillary Rheometer" Modern Plastics, pp. 110, Aug. 1991.
Clark, B. Troubleshooting with a Multimeter The Family Handyman, vol. 50, No. 4, pp. 23, Apr. 2000.
"2001 Trade Show in Print" Appliance, vol. 58, No. 5, pp. 85, May 2001.
"Utilities-Gas" Builder, vol. 24, No. 1, pp. 184, Jan. 2001.
"An Appliance Focus" Robert Shaw Appliance Controls: Appliance, vol. 50, No. 11, pp. S28, Nov. 1993.
Henry, A. "Convenience that Cooks", Appliance, vol. 49, No. 5, pp. 39(4), May 1992.
Simpson, D. E. "Switching on in the 90's" Appliance, vol. 47, No. 3, pp. 39(5), Mar. 1990.
Durocher, J. "Ranges and Cook tops" Restaurant Business, vol. 88, No. 3, pp. 172(2), Feb. 10, 1989.
"Gaggenau USA Introduces New Dimension Cook top Line" HFD—The Weekly Home Furnishings Newspaper, vol. 62, No. 8, pp. 86(2), Feb. 22, 1988.
Power, M. & Weber, C. "Full Circle" Builder (Natl Assoc of Home Builders) vol. 24, No. 1, Jan. 2001.
"Indoor Grills Handy, Capable Cookers" Consumer Reports, vol. 58, No. 2, pp. 90-93, Feb. 1993.
PIC12C509A "8-Bit Microcontroller" PIC12C5XX, Microchip Technology, 8-Pin, 8-Bit CMOS Microcontrollers 1999.
"Electric Charbroilers" Restaurant & Institutions, vol. 111, No. 25, pp. 94, Oct. 15, 2001.
AN512 "Implementing Ohmmeter/Temperature Sensor"Microchip technology, 1997, 2002.

* cited by examiner

PROFILE A

402

| SWITCH POSITION SIGNAL | DUTY CYCLE |
|---|---|
| 0000 | 0% |
| 0001 | 1% |
| 0010 | 2% |
| 0011 | 3% |
| 0100 | 4% |
| 0101 | 5% |
| 0110 | 8% |
| 0111 | 10% |
| 1000 | 15% |
| 1001 | 20% |
| 1010 | 25% |
| 1011 | 30% |
| 1100 | 40% |
| 1101 | 50% |
| 1110 | 75% |
| 1111 | 100.0% |

FIG. 4A

PROFILE B

404

| SWITCH POSITION SIGNAL | DUTY CYCLE |
|---|---|
| 0000 | 0% |
| 0001 | 3.1% |
| 0010 | 4.5% |
| 0011 | 6.2% |
| 0100 | 7.9% |
| 0101 | 13.2% |
| 0110 | 21.8% |
| 0111 | 35.7% |
| 1000 | 43.5% |
| 1001 | 50.0% |
| 1010 | 55.8% |
| 1011 | 63.9% |
| 1100 | 78.7% |
| 1101 | 90.5% |
| 1110 | 96.2% |
| 1111 | 100.0% |

FIG. 4B

POWER CONTROL MODULE FOR ELECTRICAL APPLIANCES

CROSS-REFERENCE TO RELATED APPLICATIONS

This application is a continuation-in-part application of and claims priority to U.S. application Ser. No. 11/242,629, entitled "Control of A Cooktop Heating Element", and filed on Oct. 3, 2005 now U.S. Pat. No. 7,304,274, which itself is a continuation application of U.S. application Ser. No. 10/206,885, now, U.S. Pat. No. 6,951,997, filed Jul. 26, 2002, the contents of which are hereby incorporated by reference in their entirety.

BACKGROUND

Power control modules are configured to regulate the delivery of power supply to loads (e.g., electrical appliances, for example, cooktop appliances with heating elements, ovens, warming display cases, warming cartridges, etc.) As such, power control modules include a user control mechanism to enable the user to specify the power level, or some other equivalent value, such as temperature, the user desires to have delivered to the loads, and a mechanism by which the power provided by an external power source is regulated and delivered to the load.

The efficiency of a power control module is often a function of the module's power rating (e.g., how much power the module can handle) and the module's size. Typically, the physical dimensions of the power module are proportional to the module's power rating. In general, the more power the module has to handle, the larger the physical dimensions of the module need to be. This relationship is partly the result of the larger components (e.g., power level reduction components), and partly the result of the module's size requirement to efficiently dissipate heat generated from the operation of the power control module.

SUMMARY

In general, the invention features (a) a user control to generate a heat level input signal responsive to a user of an electrical appliance, (b) logic to generate an output signal having a duty cycle corresponding to the input signal, (c) an electromechanical device connected to apply power from a source to a load in response to the output signal, and (d) a housing to receive the electromechanical device.

In one aspect, a power module to regulate delivery of power to one or more loads is disclosed. The module includes a logic circuit configured to generate one or more control signals indicative of the power level to be applied from an external power supply coupled to the power module to the one or more loads, an electromechanical device configured to electrically connect the external power supply to the one or more loads based on the one or more control signals from the logic circuit, a user-controlled circuit configured to provide a signal indicative of a power level to deliver to the one or more loads, the signal is based on input received from a user-controlled actuator configured to be placed in one of a plurality of positions corresponding to user-provided input, and a housing configured to receive the electromechanical device.

Embodiments may include one or more of the following.

The electromechanical device may include a relay. The relay mat include a metal strip configured to be displaced from a first open position to a second closed position in which the external power source is electrically connected to the one or more loads, and a solenoid configured to cause the metal strip to be displaced from the first position to the second position when the solenoid is activated.

The housing may be constructed from electrically insulating materials.

The user-controlled circuit may include a switch having a plurality of positions that are each associated with a different power setting to control the logic circuit. The switch may include an encoder configured to produce an input signal to control the logic circuit based on the position of the user-controlled actuator. The switch may include a multi-position switch connected to a series of resistors to provide discrete resistance steps relative to the angular position of the multi-position switch.

The power module may further include the user-controlled actuator which may include a shaft having one end coupled to the user-controlled circuit.

The power module may further include a DC power supply circuit configured to provide DC current to, for example, the logic circuit and/or the electromechanical device. The DC power supply circuit may be a non-transformer based power supply circuit. The non-transformer based DC power supply circuit may include, for example, a diode, a capacitor and/or a resistor.

At least one of the DC power supply and/or the logic circuit may be disposed on a circuit board, and the circuit board may be mounted onto the housing.

The power module may be configured to be connected to apply power to at least two loads. The power module may be configured to control the power applied by the power supply circuit to the at least two loads independently.

Each position of the user-controlled circuit may be associated with a corresponding duty cycle, each corresponding duty cycle causing the electromechanical device to apply power for a duration determined by the corresponding duty cycle.

The logic circuit may include logic configured to generate the one or more control signals indicative of a duty cycle based on user-provided input, the logic including an input to receive a profile selection signal, and a data memory for profiles, each profile defining an association between input signals and output signals, and in which the logic uses the profile selection signal to select one of the profiles, the input signals being the same for each profile. The electromechanical device connects the external power supply to the one or more loads based on the output signals generated by the logic.

The power module may further include a zero crossing detection circuit configured to receive AC power from the external power supply and generate a signal indicative of the zero crossing of the AC power.

In another aspect, an electric appliance is disclosed. The electric appliance includes one or more loads, and at least one power module electrically coupled to the one or more loads. Each of the at least one power module includes a logic circuit configured to generate one or more control signals indicative of the power level to be applied from an external power supply coupled to the power module to the one or more loads, an electromechanical device configured to electrically connect the external power supply to the one or more loads based on the one or more control signals from the logic circuit, a user-controlled circuit configured to provide a signal indicative of a power level to deliver to the one or more loads, the signal is based on input received from a user-controlled actuator configured to be placed in one of a plurality of positions corresponding to user-provided input, and a housing configured to receive the electromechanical device.

In some embodiments, the electrical appliance may include a cooking top range. In some embodiments, the electrical appliance may include, but is not limited to, a warming display case, an oven, a warming cartridge, etc. In some embodiments, the one or more loads may be a heating element.

Other features and advantages of the invention will be apparent from the description and from the claims.

DESCRIPTION

FIGS. 4A and 4B are profile tables.

Like reference symbols in the various drawings indicate like elements.

DETAILED DESCRIPTION

Disclosed herein is a power module to regulate delivery of power to one or more loads, such as a heating element of a cook top. The power module includes a logic circuit configured to generate one or more control signals indicative of the power level to be applied from an external power supply coupled to the power module to the one or more loads, and an electromechanical device configured to electrically connect the external power supply to the one or more loads based on the one or more control signals from the logic circuit. A user-controlled circuit is configured to provide to the logic circuit a signal indicative of a power level to deliver to the one or more loads. The signal provided by the user-controlled circuit is based on input received from a user through a rotatable user-input mechanism, such as a knob attached to a rotatable shaft.

The power module also includes a housing configured to receive the electromechanical device. Vent openings formed in one or more of the housing's walls enable heat, generated, for example, by the electromechanical device, to be dissipated. Thus, by securing the electromechanical device directly to the housing to thereby enable efficient heat dissipation, a higher power rating for the power module can be achieved.

Figure 1:
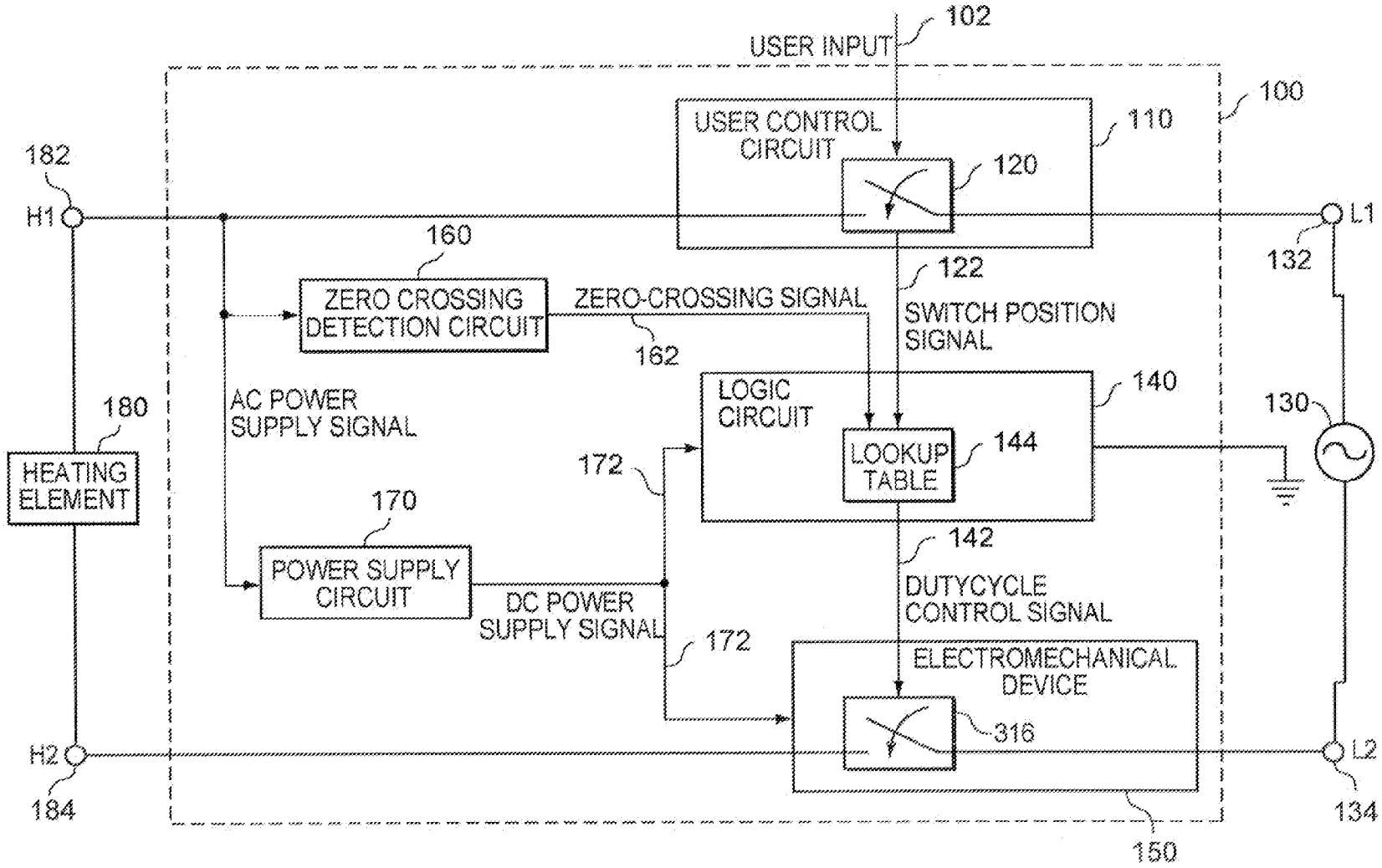
FIG. 1 is a block diagram of an exemplary embodiment of a power module.

FIG. 1 is block diagram of an exemplary embodiment of a power module 100 configured to regulate the power delivered to a load 180, here one or more heating elements of a cooktop range. As will become apparent below, the various modules and components that comprise the power module 100 are either disposed inside a housing of the power module 100, such as housing 200 (FIG. 2A), or on a circuit board 240 (FIG. 2A) that is mounted and secured onto the housing 200. For example, the electromechanical device 150 shown in FIG. 1 is integrated onto the housing. Such an arrangement facilitates better heat dissipation from the electromechanical device through heat vents formed on the walls of the housing, and thus enables higher power rating electromechanical devices to be used. Such an arrangement therefore enables the power module 100 to deliver more power to the load 180 than what could have been delivered had the electromechanical device 150 been disposed elsewhere in the power module 100.

As shown, the power module 100 includes a user-control circuit 110 attached a to a user-controlled actuator 102 that enables a user to specify the desired power level to be delivered to the load. The user-controlled circuit 110 uses the mechanical position of the user-controlled actuator 102 to generate switch position signals that are provided to a logic circuit, which in turn generates control signals to regulate the operation of the electromechanical device 150.

Once a switch 120 becomes closed, through operation of the user-controlled actuator, a terminal 132 of a power source 130, coupled to the power module 100, is electrically coupled to a terminal 182 of the load 180 that is likewise electrically coupled to the power module 100. Another terminal 134 of the power source 130 is electrically coupled, via the electromechanical device 150, to another terminal 184 of the load 180. When the electromechanical device 150 is actuated to a closed position, whereby an electrical path is completed between the power source 130 and the load 180, a closed circuit is thus formed between the power source 130 and the load 180.

The electromechanical device 150 is configured to regulate current transmission to the load connected to the power module 100 based on the user-determined input. In some embodiments the electromechanical device 150 is a solenoid-based relay device such as a KLTF1C15DC48 relay from Hasco Components International Corporation. Other relays, which include all types of electromagnetic switching devices, may be used instead. In some embodiments, a TRIAC device may be used as a solid state switching solution in place of the relay. Under such circumstances, a TRIAC component can also be used to reduce the voltage level received from the external AC power source. Other types of switching devices may be used.

Electrical actuation of the electromechanical device 150, and thus regulation of the power delivered to the load 180, is performed using a logic circuit 140. A signal 142 generated by the logic circuit 140 in response to the output of the user-control circuit 110, causes the electromechanical device to intermittently open or close, in a controlled manner, the electrical path from terminal 134 of the power source 130 to the terminal 184 of the load 180. Thus, by controlling the period during which the electromechanical device is activated (and thus the electrical path between the power source 130 and the load 180 is closed), the power delivered to the load 180 is controlled. For example, the logic circuit 140 can generate the control signal 142 that causes the electromechanical device 150 to become active for a pre-determined period of time. This period during which the electromechanical is activated is sometimes referred to as the duty-cycle of the electromechanical device 150. Further description of controlling the duty cycle of an electromechanical device is provided, for example, in U.S. Pat. No. 6,951,997, entitled "Control of a Cooktop Heating Element."

In some embodiments the logic circuit 140 generates the control signal 142 using look-up tables that are stored in a memory module 144 of the logic circuit 140. The logic circuit 140 can include any computer and/or other types of processor-based devices suitable for multiple applications. For example, a suitable computing device to implement logic circuit 140 is an 8-bit microcontroller device, such as a PIC12C509A microcontroller from Microchip Technology Inc.

The computing device that may be used to implement the logic circuit 140 can include volatile and non-volatile memory elements, and peripheral devices to enable input/output functionality. Such peripheral devices include, for example, a CD-ROM drive and/or floppy drive, or a network connection, for downloading software containing computer instructions. Such software can include instructions to enable general operation of the processor-based device. Such software can also include implementation programs to generate the control signal 142 for controlling the actuation of the electromechanical device 150. The logic circuit 140 may also include a digital signal processor (DSP) to perform some or all of the processing functions described above.

The duty cycle control signal 142 specifies both the turn on and turn off moments in each duty cycle. The logic circuit 140 bases the duty cycle control on the output signal 122 from the user-control circuit, which indicates the rotational position of the user-controlled actuator 102 (and hence the desired level of heating).

With reference to FIGS. 4A and 4B, in some embodiments the memory module 144 may be loaded (either at time of manufacture or, in some implementations, later) with any desired power-level profile, such as a profile A 402 (FIG. 4A), or profile B 404 (FIG. 4B). For example, a profile specified by an electric range manufacturer for a particular electric range model could be used. In some implementations, the profiles 402 and 404 could be modified to meet a user's expected cooking requirements. For example, profile B could be used to enable several low duty cycle rates (e.g., in the range 3% to 8%) for effective simmering of candy and chocolate sauces. Profile B provides a smaller spread of duty cycle rates over a wider range of switch positions as compared to profile A 402. The loading of different profiles could be done in response to preferences indicated by the user.

The precise turn-on and turn-off times of the duty cycle are selected so that they occur approximately when the AC power source is crossing through zero, to reduce stress on the electromechanical device 150. For that purpose, the power module 100 includes a zero crossing detection circuit 160 that determines the zero crossing times and indicates those times to the logic circuit 140 using zero-crossing signal 162. Thus, the logic circuit 140 will generate duty-cycle control signal 142 so that the signal 142 substantially coincides with the zero-crossing of the external AC power source 130.

Power module 100 further includes DC power module 170 that generates DC power (via power line 172) from the AC power source 130. The DC power module 170 powers the logic circuit 140 and the electromechanical device 150. The DC power from module 170 is thus used to provide the power to switch the electromechanical device 150, and thereby control the delivery of AC power to the load 180.

Optionally, in some embodiments the power module 100 may also include a feedback power level adjustment mechanism to adjust the power delivered to the load 180. Particularly, a sensor may be coupled to the load to monitor power consumption by the load. An electrical control circuit could receive data from the sensor indicative of the power level at which the load is operating and compare that data to the desired power level as indicated, for example, by the duty-cycle control signal. If there is a discrepancy between the actual monitored power level as indicated by the sensor's data and the desired power level, the power level adjustment mechanism (which may be implemented on the logic circuit 140) can make necessary adjustments to the signal 142. The adjusted signal 142 will then cause the electromechanical device 150 to operate so that the discrepancy between the actual power level of the load 180 and the desired power level as specified by the user is minimized, or eliminated. This type of control mechanism is referred to a closed-loop adjustment mechanism.

Figure 2A:
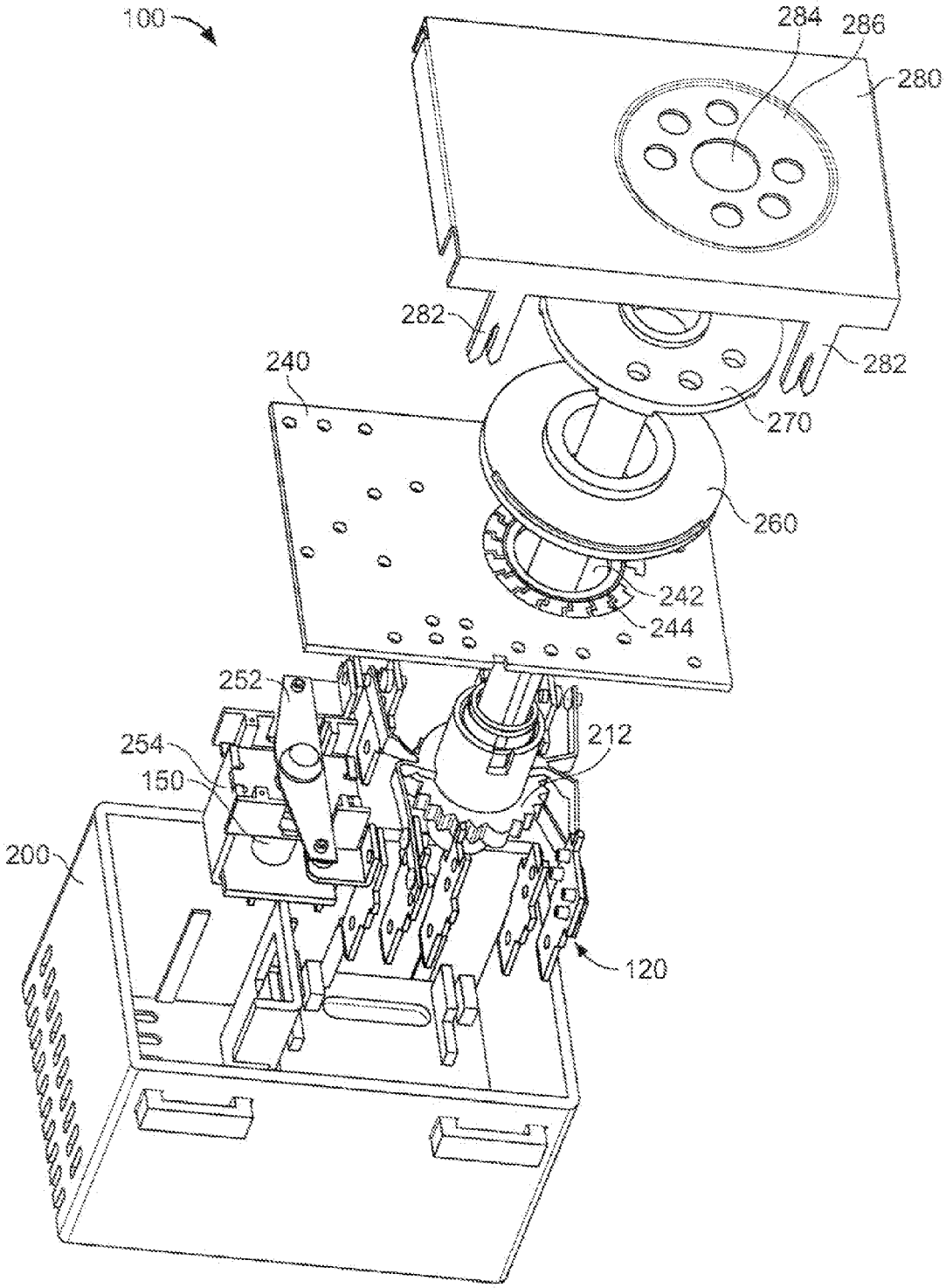
FIG. 2A is an exploded view of an exemplary embodiment of the power module of FIG. 1.

FIG. 2A is an exploded view of an exemplary embodiment of the power module 100. The power module 100 includes a housing 200, having vents (shown in FIG. 2B), which is configured to receive the electromechanical device 150, such as a KLTF1C15DC48 relay, that regulates the current transmission to the load 180 coupled the power module 100 (not shown in FIG. 2A). By having the electromechanical device 150 affixed directly to the housing and not, for example, to the circuit board 240, the housing 200 can serve as an efficient heat sink for the electromechanical device. Heat generated by the electromechanical device 150 is dissipated through the vents formed in the housing 200. The integration of the electromechanical device 150 to the housing can thus minimize temperature rise in the power module, thereby enabling the power module 100 to operate at a higher rating. As explained above, the electromechanical device 150 is electrically coupled to an external AC power source 130, and transmits the electrical current provided by the external AC power source in response to the control signals 142 generated by the logic circuit 140 (as shown in FIG. 1). Thus, the power module can control the power delivered and consumed by the load 180. The power required to switch the electromechanical device on or off is provided by the DC power supply module 170.

As further shown in FIG. 2A, affixed to the output terminal of the electromechanical device 150 is an electrically conductive strip 252 (e.g., a metal strip.) The strip 252 is secured to a support structure 254 to which the electromechanical device 150 is also secured. The strip 252 can be secured to the support structure 254 using, for example, screws. The electrically conductive strip 252 functions as a switch that is actuated by the electromechanical device 150, and which causes the strip 252 to make and break a contact through which power to the load from the external power source 130 passes.

Figure 2B:
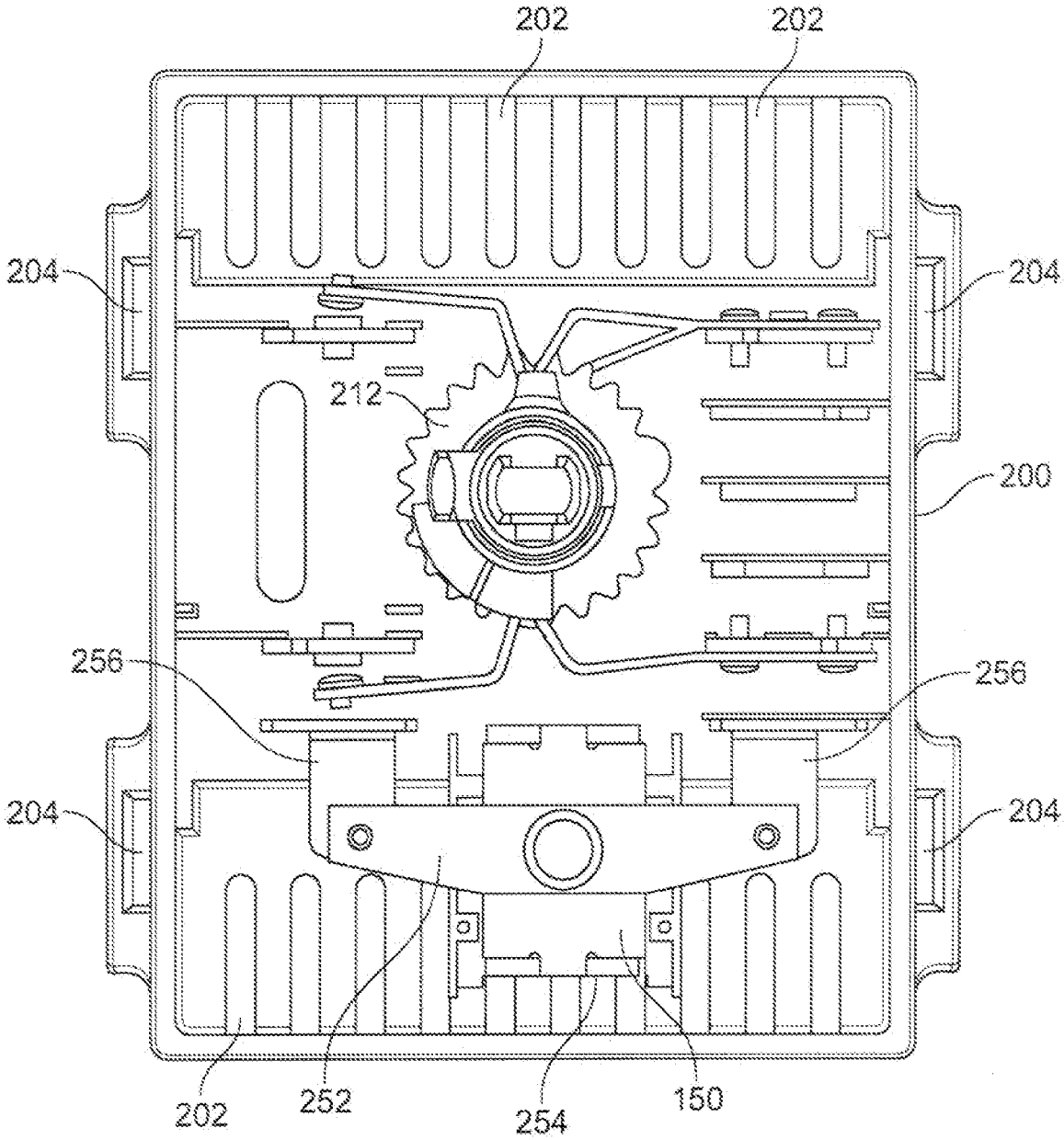
FIG. 2B is a top view of an exemplary embodiment of the housing shown in FIG. 1.
Figure 2C:
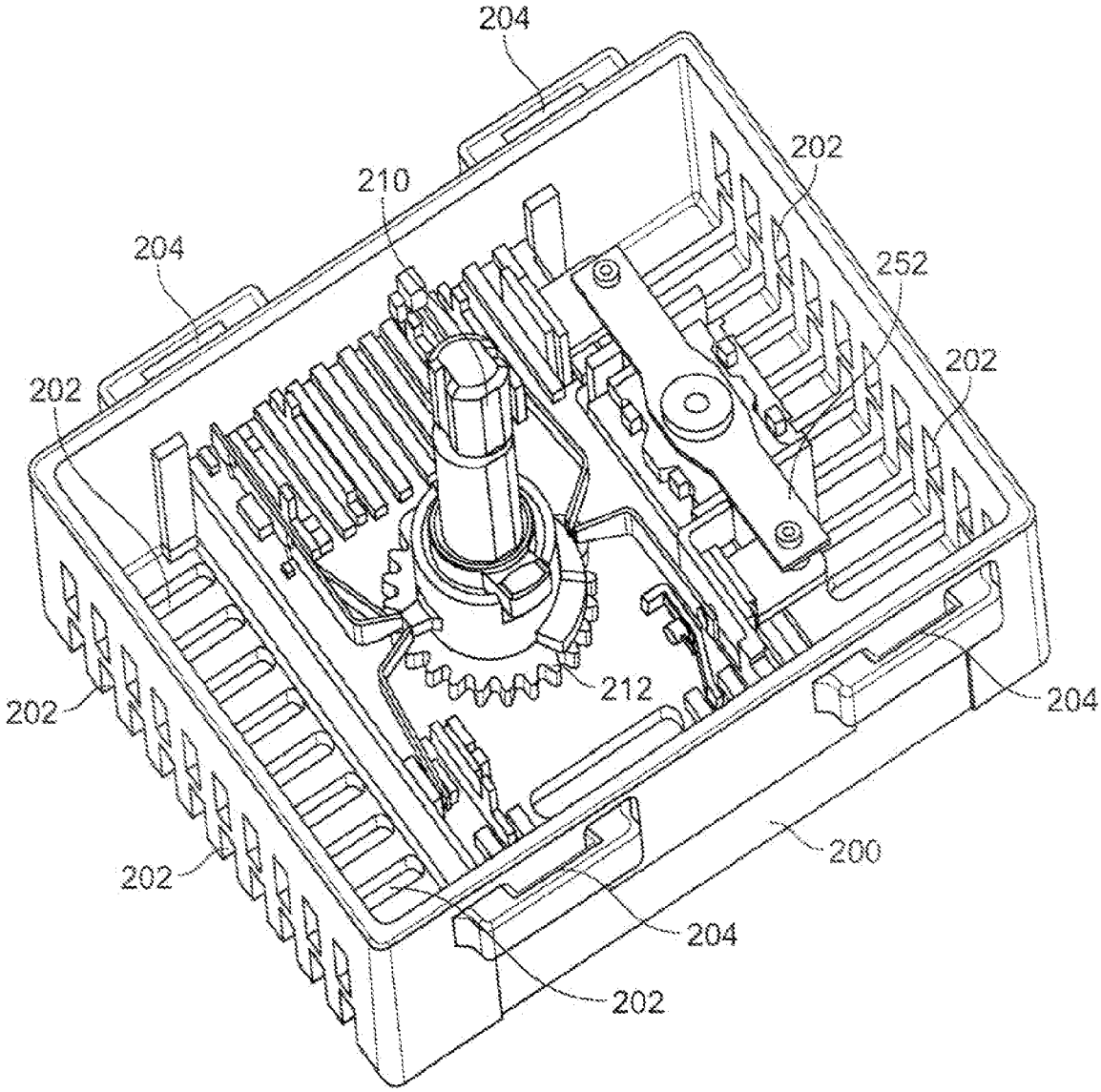
FIG. 2C is a perspective view of the housing shown in FIG. 2B.
Figure 2D:
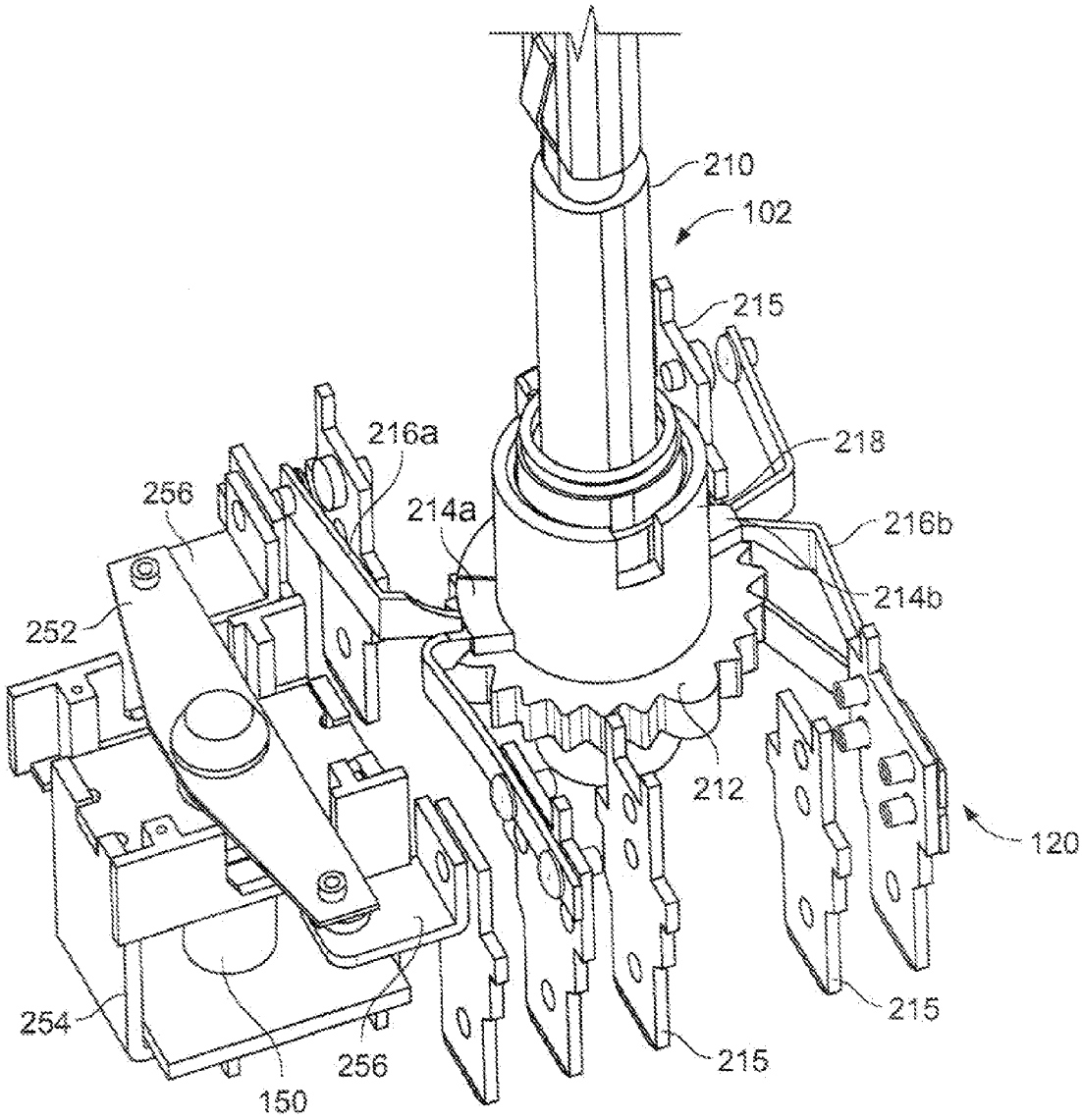
FIG. 2D is a partial perspective view of some of the components of the power module secured to the housing of FIGS. 2A, 2B and 2C.

Particularly, and with reference to FIGS. 2B, 2C and 2D, showing respectively a top view of the housing 200, a perspective view of the housing 200, and a partial perspective view of some of the components secured to the housing 200, when the electromechanical device 150 is activated (e.g., in response to control signals from the logic circuit 140), a magnetic field is created, for example in the solenoid of the electromechanical device, which causes the strip 252 to be pulled towards electrical conductive plates 256, thereby causing the strip 252 to come in contact with the plates 256 to form a close circuit through which current from the AC power source 130 can be delivered to the load.

As further shown in FIG. 2B, formed on at least one wall of the housing 200 are vent openings 202 that enable circulation of air through the housing 200 to facilitate dissipation of heat generated by, for example, the electromechanical device 150. As shown in FIG. 2C, vent openings may also be formed on other walls that form the housing 200.

In the embodiment shown in FIG. 2A, the strip 252 is positioned so that its central point is approximately above the electromechanical device 150. Such a design can improve the durability, and thus longevity, of the strip 252, and of the electromechanical device 150.

As further shown in FIGS. 2A-D, also secured to the housing 200 is a rotatable shaft-based actuation mechanism that serves as the user-controlled actuator 102. The user-controlled actuator 102 is configured to assume a number of positions that are each associated with a different power settings to control a control circuit (not shown in the figures) such as user control circuit 110. A user can turn a knob (not shown) attached to the shaft of the actuator 102 and thereby cause the actuator 102 to assume one of a number of positions. This in turn causes the user-control circuit 110, to which the actuator 102 is mechanically coupled, to generate the switch-position signal 122 that is provided to the logic circuit 140.

The user-controlled actuator 102 is further configured to activate the power module 100 when the user-controlled actuator is rotated to a position corresponding to one of the power-on positions. With reference to FIG. 2D, a detent ring 212 is mechanically coupled to a shaft 210 (which is part of the user-controlled actuator 102). The detent ring 212 is disposed in the housing 200. Disposed on the detent ring 212 is a rotator 218 that is configured to receive the shaft 210 and to facilitate rotational actuation of the detent ring 212 when the shaft 210 is rotated. The detent ring 212 includes a cam 214*a*, and the rotator 218 includes a cam 214*b*. When the user-controlled actuator is in its power-off position, the cams 214*a* and 214*b* push respective resilient fingers 216*a* and 216*a* of the on/off switch 120 outwards, thereby causing the related contacts of the switch to be in their open positions. However, when the user-controlled actuator is moved to a position in which power is delivered to the load 180, the movement of the user-controlled actuator causes the detent ring 212 and the rotator 218 to rotate to another position in which the cams 214*a* and 214*b* no longer contact the resilient fingers 216*a* and 216*b*, respectively, of the switch 120. This in turn causes the resilient fingers, which are biased towards the shaft 210, to be displaced towards the shaft 210, and thereby cause their related contacts to move to their closed position. Accordingly, under these circumstances (i.e., when the user-controlled actuator is in one if its power-on positions), power can be delivered to the load 180.

As further shown in FIG. 2A, the power module 100 also includes a circuit board 240 on which the logic circuit 140, DC power supply circuit 170 and the zero-crossing circuit 160 are disposed. As can be seen, the circuit board 240 includes a hole 242 through which the shaft-based user actuator 102 is received. An encoder trace 244, configured to transform the rotational position of the user-controlled actuator into electrical signals that can be used by the logic circuit 140, is placed around the circumference of the hole 242.

As shown in FIG. 2D, to mechanically secure the circuit board 240 to the housing 200, vertical tabs 215 are used to align and connect some of the components disposed inside housing 200 (e.g., the switch 120, the resilient fingers 216*a* and 216*b*) to the circuit board 240.

Disposed over the hole 242 of the circuit board 240 is a rotator 260, which is in the form of an annular disk configured to receive the user-controlled actuator 102, and is further configured to be rotated to a number of positions in response to rotation of the user-controlled actuator 102. Thus, movement of the user-controlled actuator 102 to a particular rotational position will result in a corresponding change of the rotational position of the rotator 260. The particular position of the rotator 260 causes the corresponding switch position signal 122 to be generated.

Figure 2E:
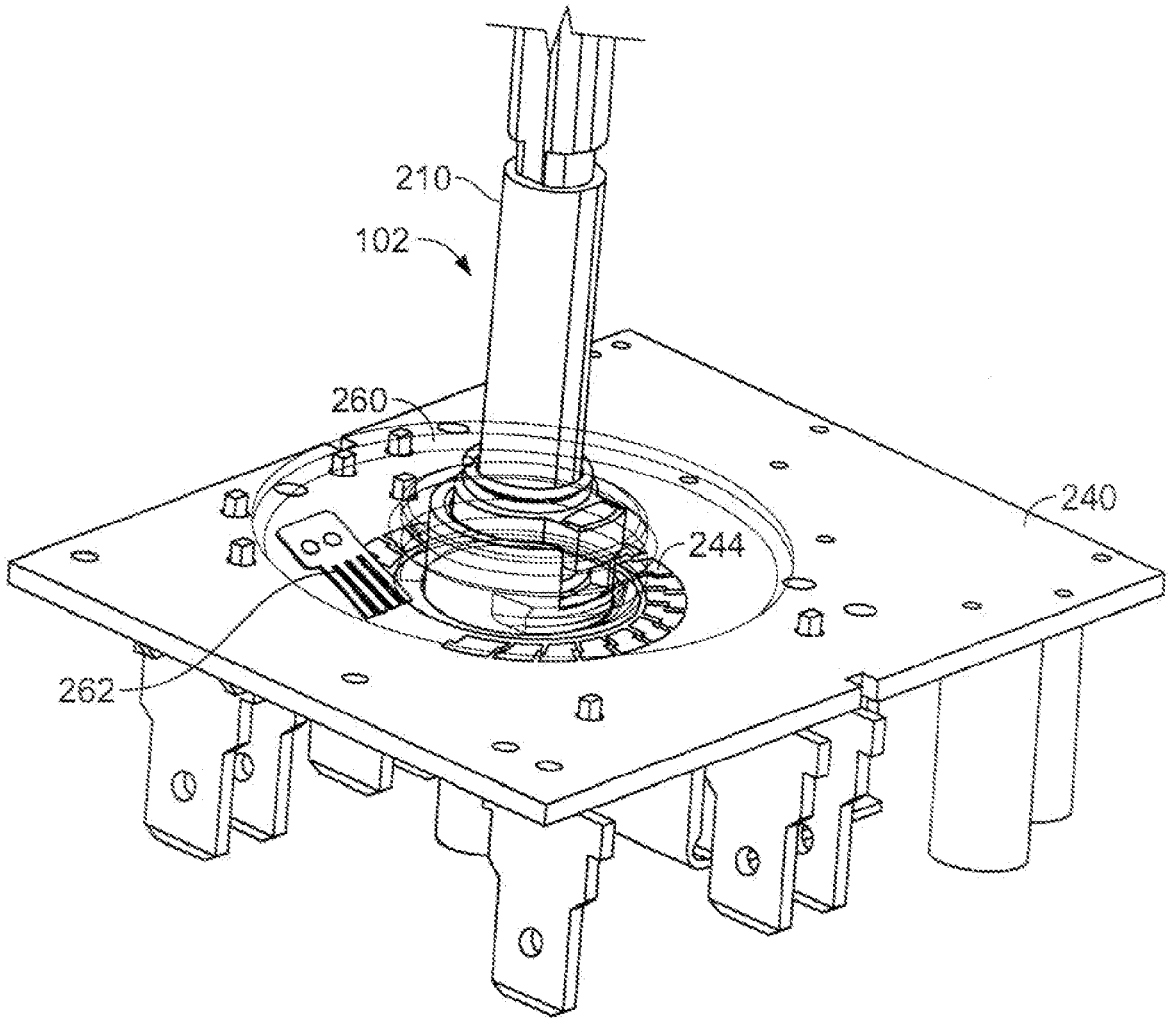
FIG. 2E is a perspective view of the circuit board shown in FIG. 2A, and metal wipers, for generating positional signals, disposed above the circuit board.

More particularly, and with reference to FIG. 2E, to generate the switch position signal 122, an encoder circuit is implemented as a resistance-based analog encoder configured to generate a switch position signal indicative of the rotational position of the rotator 260. As shown, the rotator 260 includes metal wipers 262 that are affixed to the bottom surface of the rotator 260 (for the purpose of illustration, the outlines of the rotator 260 are shown in FIG. 2E). The metal wipers 262 face the surface of the board 240, and are disposed above the encoder trace 244 that is divided into multiple segments. Electrically coupled to the multiple segments are resistors (shown schematically in FIG. 6) such that one terminal of each resistor in the arrangement is electrically coupled to one of the encoder trace segments. When the rotator 260 is actuated to a particular rotational position, the metal wipers 262 come in contact with one of the segments of the encoder trace 244. Consequently, the total resistance that will be realized from coupling the resistor connected to the encoder trace segment to the rest of the serial connection of resistors will change, thereby changing the voltage level of the switch position signal 122. The voltage level is indicative of the rotational position of the user-controlled actuator 102, and can thus be used by the logic circuit 140 to generate the appropriate signal 142 to regulate the operation of the electromechanical device 150. In some embodiments the resistor element coupled to the encoder circuit may be a variable resistor (e.g., a potentiometer) that is used to provide the variable resistance required to implement the encoder circuit.

In some embodiments the encoder circuit can be implemented as either an absolute or a relative rotary encoder. In some embodiments, a digital encoder can be used in which, for example, a unique 4 bit binary output is generated for each of sixteen (16) distinct positions of the user-controlled actuator 102.

Turning back to FIG. 2A, the power module 100 also includes a housing cover 280 adapted to fit over the opening of the housing 200. A circular ribbed section 286 includes a hole 284 through which the shaft 210 passes. The ribbed section 286 strengthens the structural integrity of the housing cover 280 to reduce incidents of breakage due to mechanical forces exerted on the actuator 102, and by the actuator 102, on the housing cover 280. A bushing 270, shaped as an annular disk having radially positioned holes along the disk's surface, is placed underneath the housing cover 280, substantially below the rib section 286 of the housing cover 280. The bushing 270 provides the housing cover 280 with mechanical rigidity.

The housing cover 280 includes U-shaped tabs 282 that extend perpendicularly to the surface of the cover 280. When the cover 280 is fitted over the housing 200, the tabs 282 are received within mounting slots 204 formed on the outer surface of the housing 200 (see FIGS. 2B and 2C). The tabs 282 thus latch into the mounting slots 204 to maintain the housing cover 280 secured to the housing 200.

Figure 3:
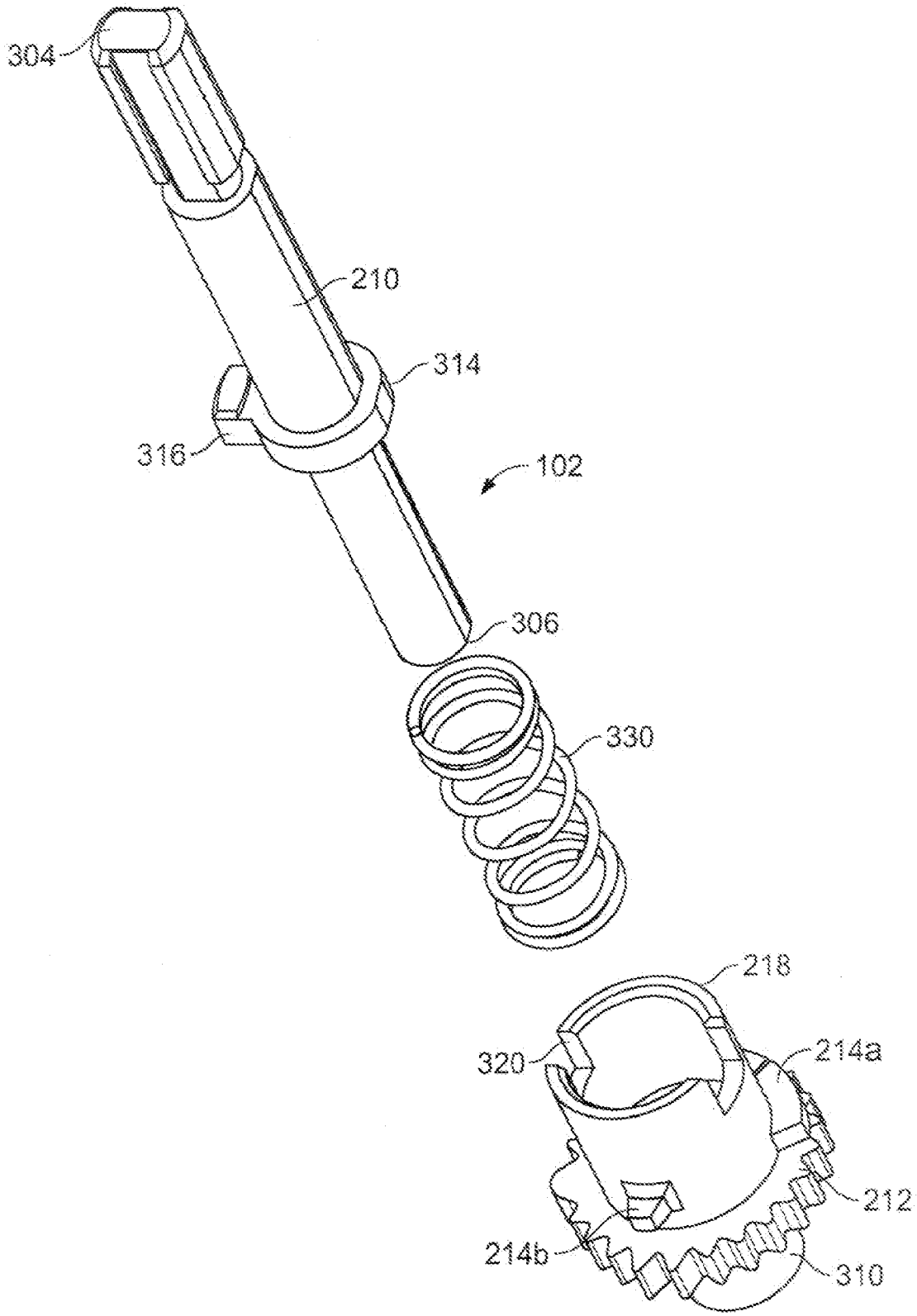
FIG. 3 is an exploded view of an exemplary embodiment of the shaft-based actuator shown in FIGS. 2A-2D.
Figure 3A:
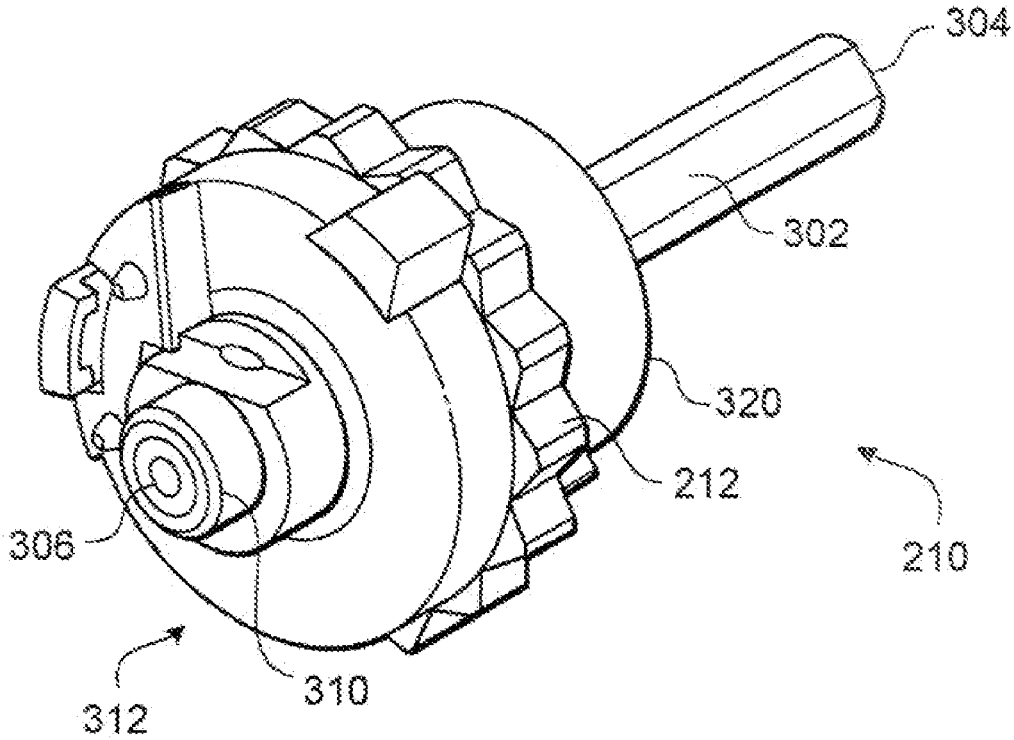
Figure 3B:
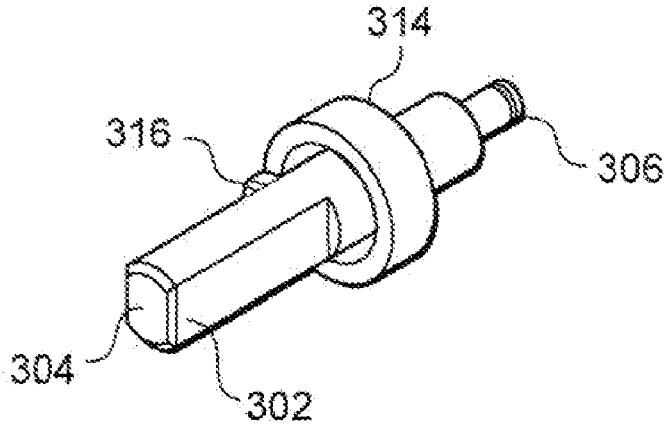

As noted above, in some embodiments the user-controlled actuator 102 is implemented as a shaft-based actuator 210 that is configured to be rotated to a plurality of positions. With reference to FIG. 3, showing an exploded view of the shaft-based actuator 210, the shaft 210 has an end 304 that is configured to be received within a user-rotatable knob (not shown). Application of force by the user to rotate the knob causes the shaft 210 to rotate. The other end 306 of the shaft 210 rests within a bearing 310 to which the detent ring 212 is secured. As assembled, the outer surface of bearing 310 is fitted into an open-ended hollow cylinder (not shown) extending from the bottom surface of the housing 200.

The shaft 210 includes a ring 314. A key 316, extending from the ring 314, is received within a slot 320 defined in the rotator 218 when the shaft 210 is pushed inwardly towards the housing 200. Once the key 316 is received within the slot 320, rotation of the shaft 210 will cause the rotator 218 to rotate. As further shown in FIG. 3, the user-controlled actuator 102 also includes a coil spring 330 that is fitted within the inner volume of the rotator 218. The coil spring 330 is biased in an outward direction from the rotator 218 such that when the shaft 210 is pressed towards the rotator 218, the coil spring 330 resists the inward movement of the shaft 210. The coil spring 330 thus prevents errant rotation of the rotator 218. Particularly, to cause the rotator 218 to rotate (and thus cause the power module to be in an ON or OFF position,) it is necessary for a user to first apply inward force on the knob and/or the shaft 210, and only after to rotate the knob.

The shaft 210 passes through the hole 242 formed on the circuit board 240 (shown in FIG. 2A), and through the hole 284 (FIG. 2A) formed on the cover 280 that is placed over the housing 200 once the circuit board 240 is disposed inside the inner volume of the housing module 200, such that the end 304 of the shaft 210 protrudes from outside the hole on the cover 280 of the housing module. The open-ended hollow cylinder on the bottom surface of the housing module 200, the hole 242 on the circuit board 240 and the hole 284 of the cover 280 through which the shaft 210 passes are substantially aligned along a common axis. As noted, a knob can be mounted on the end 304 of the shaft 210.

Figure 5:
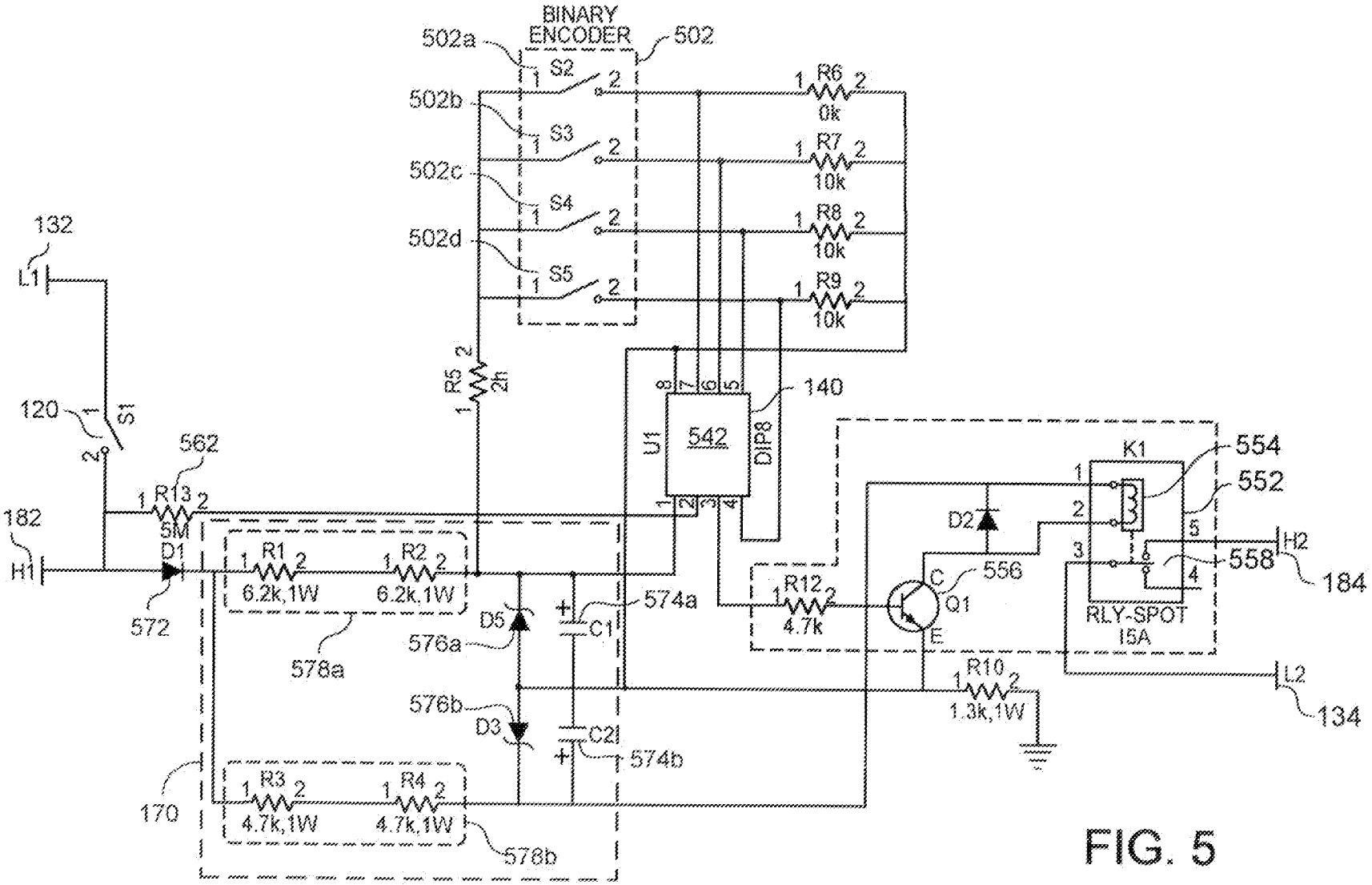
FIG. 5 is a schematic of an exemplary embodiment of a partial circuit of the power module of FIG. 1.

FIG. 5 shows a schematic diagram of an exemplary embodiment of an electrical circuit 500 that is used to implement the electromechanical device 150 and the control circuitry used to control the electromechanical device 150. In some embodiments, an absolute rotary encoder 502 is used to generate the signal 122 that is provided as input to logic circuit 140. The rotary encoder 502 includes switches S2 502*a*, S3 502*b*, S4 502*c*, and S5 502*d*. Rotating the user-controlled actuator 102 causes one or more of the switches 502*a-d* to close, thereby providing logic circuit 140 with a binary signal representative of the rotational position of the user-controlled actuator 102. For example, when the user rotates the knob user-controlled actuator 102 to a position corresponding to "Lo" power level setting, the switch S2 502*a* is closed and the absolute value encoder generates a switch position signal 122 of "0001." Similarly, when the user rotates the user controlled actuator 102 to a position corresponding to a "Hi" power level setting, switches S2-S5 502*a-d* are closed, and a switch position signal 122 of "1111" is generated. The binary encoder 502 may include additional switches if it desired to have more than sixteen (16) user-controlled positions for the power module. The switch position signal 122 can then be decoded by the logic circuit 140 to determine and act upon the position of the user-controlled actuator 102.

In embodiments in which the logic circuit 140 is implemented using the 8-bit PIC12C509A microcontroller 542 from Microchip Technology Inc., as shown in FIG. 5, four of the eight pins of the microcontroller, namely pins 4-7 in FIG. 5, receive the encoded position signal from the encoder 502. Two pins of the microcontroller, namely pins 1 and 8, are the power input pins through which the logic circuit 140 receives power from the DC power supply circuit 170, and one pin (pin 3) is the output pin of the logic circuit 140 that provides the duty cycle signal 142 to the electromechanical device 150. One pin can be used for either zero-crossing detection (to synchronize the generation of the output signal 142 to the zero-crossing of the AC power), or alternatively, that pin can be used as the user profile selection input.

When the switch 120 is closed, AC power flows from the power line L1 to the DC power supply circuit 170. In some embodiments, the DC power source is implemented as a non-transformer-based power supply (sometimes referred to as a non-isolated or off-line power supply), that does not have to use coiled transformer devices to achieve power reduction. By avoiding the use of coiled transformer devices, the size requirements of the power module can be reduced, thus making the power module more compact. The power source 170 can thus be implemented using a circuit that includes diodes to rectify the AC power provided by AC power source 130, and resistors and capacitors to effect the power-level reduction.

Accordingly, in some embodiments the external power supply is half-wave rectified by diode 572, filtered by electrolytic capacitors 574*a* and 574*b*, and regulated by zener diodes 576*a* and 576*b* and resistors 578*a* and 578*b* to produce a DC power supply, which is used to power the logic circuit 140 and the electromechanical device 150.

FIG. 5 further shows the zero-crossing detection circuit. In some embodiments, the zero-crossing detection circuit is implemented as a high value resistor 562 (e.g., 5 MΩ) coupled between Line 1 and the corresponding input pin of the logic circuit 140. For example, where the logic circuit 140 is implemented using the 8-bit PIC12C509A microcontroller 542, one terminal of the resistor 562 is coupled to pin 2 of the microcontroller. The high resistance limits the current so that no damage occurs to the microcontroller 542. The microcontroller 542 includes software that polls pin 2 and reads a high state whenever the AC voltage waveform is near zero volts (e.g., AC voltage ≈+2V relative to the circuit common).

Also shown in FIG. 5 is the circuit implementation of the electromechanical device 150. As can be seen, the electromechanical device includes the relay 552, such as a 15A KLTF1C15DC48 relay from Hasco Components International Corporation. A transistor 556 is coupled to output pin 3 of the microcontroller 542 of logic circuit 140 such that when the duty cycle control signal 142 is generated (e.g., it is in a high state), it drives the transistor 556. This in turn switches the relay 552 and enables current from the DC power source 170 (shown in FIGS. 1 and 5) to flow through the relay coil 554. Consequently, when current flows through the relay coils 554, a magnetic field is generated by the relay coils 554 which causes the contacts 558 to be switched on, thereby completing the power circuit from the AC power source 130 to the load 180.

In some embodiments generation of the duty cycle control signal is synchronized to zero-crossing of the AC voltage provides by AC power source 130. Thus, the actual switching of the electromechanical is performed only after pin 2, which is coupled to the transmission line from the AC power source 130, transitions from low to high, and when the duty cycle control signal 142 is high. After the duty control signal 142 goes low, the switching is again performed only after pin 2 transitions from low to high. Arcing between the contacts 558 of the relay 552 is reduced when the relay 552 is switched at or near the zero crossing points of the AC voltage waveform. This has the effect of reducing contact erosion and prolonging the useful service life of the relay 552.

Although not shown in FIG. 5, it should be noted that optionally the power level of the external AC power source (e.g., such as an external AC 120V power source) may also be reduced prior to being coupled to the electromechanical device 150. In some embodiments, the circuitry used to reduce the external power level to a level suitable for operation of power module 100 is implemented as a non-transformer-based power supply. The power reduction circuitry for the AC source can thus be implemented using diodes, resistors and capacitors. In some embodiments, transformer-based devices may be used. The circuitry to reduce the power level of the AC power source may be disposed within the power module 100, or it may be external to the power module 100.

Figure 6:
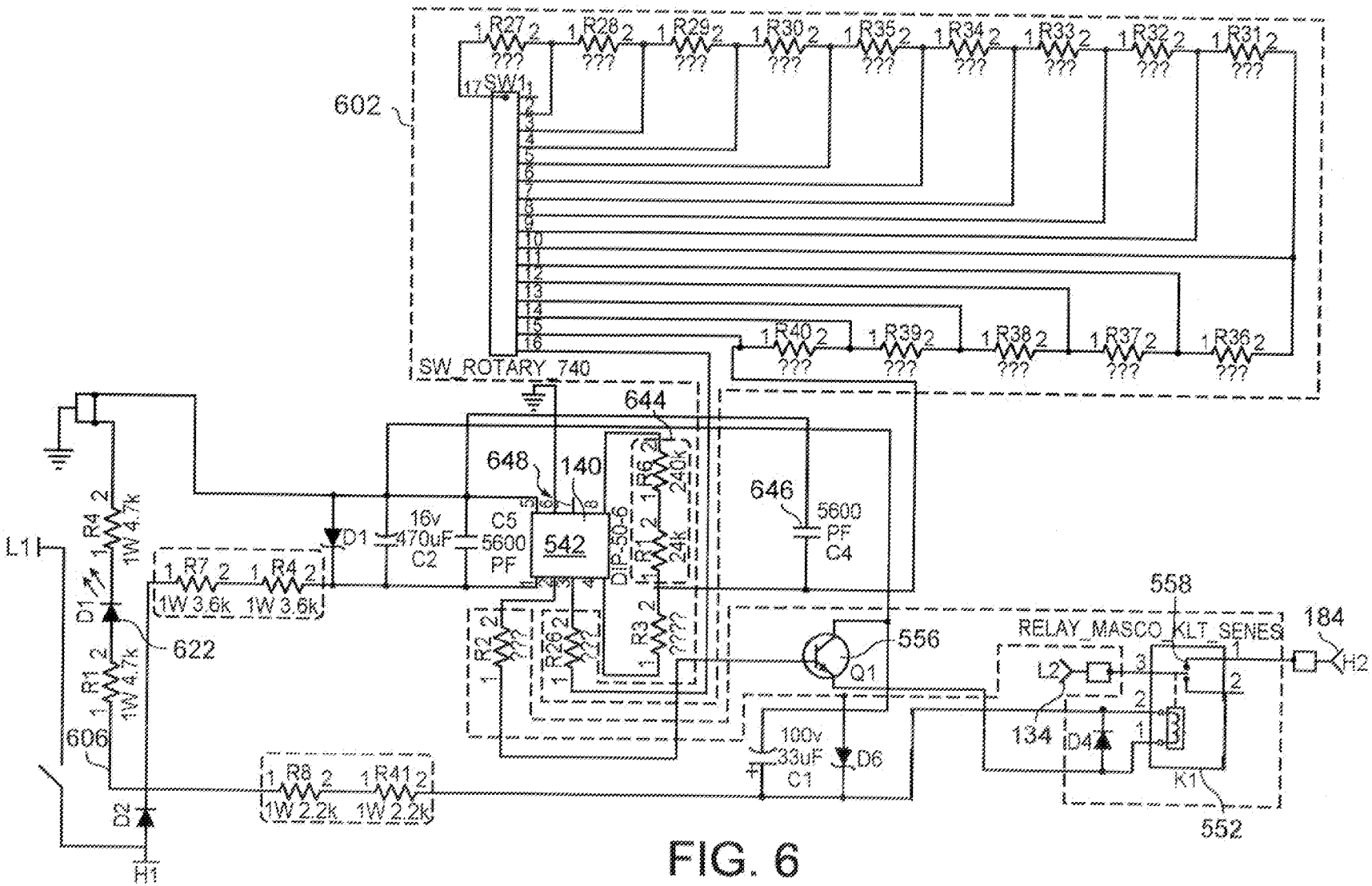
FIG. 6 is schematic of another exemplary embodiment of a partial circuit of the power module of FIG. 1.

FIG. 6 is another exemplary embodiment of an electrical circuitry 600 implementing part of the power module 100. As shown, in this embodiment the user control circuit 110 (shown in FIG. 1) is implemented as an resistance-based analog encoder configured to generate a switch position signal indicative of the rotational position of the actuator 102. The resistance value could be changed continuously using a single variable resistor, or discretely using multiple resistors arranged, for example, in series as shown in box 602 of FIG. 6. Thus, different resistance values corresponding to different positions of the actuator 102 will result in corresponding voltage values indicative of the position of the actuator 102.

In the analog encoder implementation, the logic circuit 140 may use a capacitive charging circuit to convert a resistance-based switch position signal 122 to time periods, which can be easily measured using the logic circuit (such as the microcontroller 542, also shown in FIG. 5). A reference voltage is applied to a calibration resistor 644. The capacitor 646 charges up until the threshold on the chip input (pin 5 of the microcontroller 542) trips. This generates a software calibration value that is used to calibrate out most circuit errors, including inaccuracies in the capacitor 606, fluctuations in the input threshold voltage, and temperature variations. After the capacitor 606 is discharged, the reference voltage is applied to the resistance to be measured. The time to trip the threshold is then measured by the microcontroller 542 and compared to the calibration value to determine the actual resistance. In some implementations, the switch position signal values in the lookup table 144 of the logic circuit 140 are time-based and reflect the time it takes for the resistance across the user control circuit 110 to trip the threshold on pin 5 of the microcontroller 542. In some embodiments a microprocessor with a built-in analog-to-digital converter could be used to read actual voltage levels.

As further shown in FIG. 6, in some embodiment, a light-emitting diode 622 may receive power from a half-rectified line 606 to thus indicate when the electrical switch 120 is closed (i.e., when the power module itself is turned to a position other than the "Off" position). Alternatively, a light-emitting diode may be connected such that the it illuminates light when power is applied to the load (i.e., during the duty cycle, when the electromechanical device 150 is switched to its closed position).

In some embodiments, the power module 100 may be manufactured for use with different appliances having different profiles (e.g., two different electric range models). The appliances may be from the same manufacturer or different manufacturers. For this purpose, the processor of the logic circuit 140 may be pre-loaded with two profiles, such as profile A 402 (FIG. 4A) and profile B 404 (FIG. 4B). The logic circuit 140 may also be loaded with software that polls a profile selection pin (e.g., pin 648, marked as pin 6 of the microcontroller 542 shown in FIG. 6) and determines which of the two profiles should be used to interpret the switch position signals. For example, if the polling returns a high value, the microcontroller 542 could interpret the switch position signals using profile A 402. Otherwise, the microcontroller 542 could interpret the switch position signals using profile B 404.

In some embodiments, the power module 100 may be manufactured with trace wiring connecting the profile selection pin 648 of the microcontroller 542 to supply voltage and supply ground, thus configuring the power module 100 to use only one specific profile from the various profiles that may be stored on the look-up table 144 of the logic circuit 140. Thus, during assembly of the power module 100, the appropriate trace wiring is punched out depending on which profile is to be used for that particular power module 100.

In other embodiments, the power module is manufactured with a profile selection switch that a homeowner can flip between one of two positions to select which of two, or more, pre-loaded profiles of the logic circuit 140 should be used in interpreting the switch position signals.

The remainder of circuit 600 is substantially the same as circuit 500 shown in FIG. 5, and operates in a similar manner.

Figure 7:
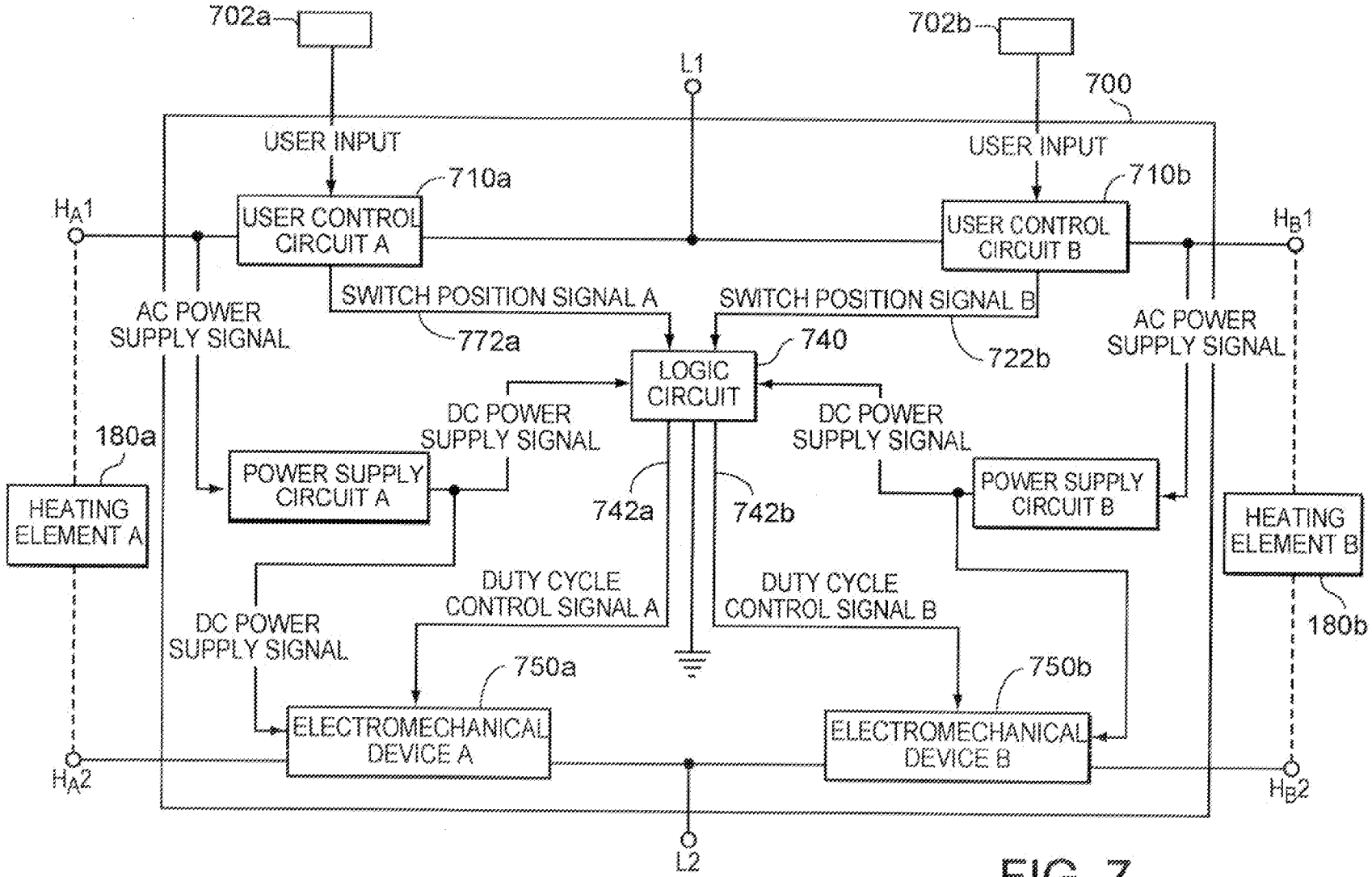
FIG. 7 is a block diagram of a further exemplary embodiment of a power module for regulating power to two loads.

FIG. 7 is a block diagram of an exemplary embodiment of a power module 700. As shown, a logic circuit 740, similar to the logic circuit 140 of the power module 100, is used to control the rate at which power is delivered to two loads (e.g., two cooktop heating elements of an electric range). Thus, the logic circuit 740 may be any type of processor-based device configured to receive input and generate control signals, such as duty cycle control signals 742*a* and 742*b*. The logic circuit receives switch position signals 722*a* and 722*b*, which are generated according to the respective actuator positions of two separate actuators 702*a* and 702*b*. The switch position signals are generated by user-control circuits 710*a* and 710*b*, in a manner similar to that described with respect to the user control circuit 110 of the power module 100. In some embodiments, the switch position signals 722*a* and 722*b* are used to select duty cycle levels from duty cycle profiles stored on one or more memory modules of the logic circuit 740.

Once generated, the duty cycle control signals 742*a* and 742*b* are provided to electromechanical devices 750*a* and 750*b*, respectively, to control the switching operations of the electromechanical devices 750*a* and 750*b*. When one of the electromechanical devices 750*a* and 750*b* is switched to its closed position, power from an AC power source is provided to the respective load coupled to the electromechanical device.

In some embodiments, the logic circuit 740 is configured to generate the duty cycle control signals independently of one another. Thus, the various loads controlled through the logic circuit 740 can be controlled independently and set to different power levels without regard to the power level the other load is set to.

Other power module configurations (e.g., a power module in which a single logic circuit can control power delivery to three or more loads) may also be implemented.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A power module to regulate delivery of power to one or more loads, the module comprising:

a logic circuit configured to generate one or more control signals indicative of the power level to be applied from an external power supply coupled to the power module to the one or more loads;

an electromechanical device configured to electrically connect the external power supply to the one or more loads based on the one or more control signals from the logic circuit;

a user-controlled circuit configured to provide a signal indicative of a power level to deliver to the one or more loads, the signal is based on input received from a user-controlled actuator configured to be placed in one of a plurality of positions corresponding to user-provided input;

at least one electrical contact communicating with the user controlled actuator to interrupt power to the one or more loads when the user-controlled actuator is in a power off position in which the signal from the user-controlled circuit also causes the logic circuit to produce a control signal causing the electromechanical device to disconnect external power supply from the one or more loads;

a housing configured to receive the electromechanical device, the user-controlled circuit, and the at least one electrical contact.

2. The power module of claim 1, wherein the electromechanical device includes a relay.

3. The power module of claim 2, wherein the relay comprises: a metal strip configured to be displaced from a first open position to a second closed position in which the external power source is electrically connected to the one or more loads; and a solenoid configured to cause the metal strip to be displaced from the first position to the second position when the solenoid is activated.

4. The power module of claim 1, wherein the housing is constructed from electrically insulating materials.

5. The power module of claim 1, wherein the user-controlled circuit includes a switch having a plurality of positions that are each associated with a different power setting to control the logic circuit.

6. The power module of claim 5, wherein the switch includes an encoder configured to produce an input signal to control the logic circuit based on the position of the user-controlled actuator.

7. The power module of claim 5, wherein the switch includes a multi-position switch connected to a series of resistors to provide discrete resistance steps relative to the angular position of the multi-position switch.

8. The power module of claim 1, further comprising a DC power supply circuit configured to provide DC current to at least one of: the logic circuit, and the electromechanical device.

9. The power module of claim 8, wherein the DC power supply circuit is a non-transformer based power supply circuit.

10. The power module of claim 9, wherein the non-transformer based DC power supply circuit includes at least one of a diode, a capacitor, and a resistor.

11. The power module of claim 8, wherein at least one of the DC power supply and the logic circuit are disposed on a circuit board, and wherein the circuit board is mounted onto the housing.

12. The power module of claim 1, wherein the power module is configured to be connected to apply power to at least two loads.

13. The power module of claim 12, wherein the power module is configured to control the power applied by the power supply circuit to the at least two loads independently.

14. The power module of claim 1, wherein each position of the user-controlled circuit is associated with a corresponding duty cycle, each corresponding duty cycle causing the electromechanical device to apply power for a duration determined by the corresponding duty cycle.

15. The power module of claim 1, wherein the logic circuit includes logic configured to generate the one or more control signals indicative of a duty cycle based on user-provided input, the logic including: an input to receive a profile selection signal; and a data memory for profiles, each profile defining an association between input signals and output signals, and in which the logic uses the profile selection signal to select one of the profiles, the input signals being the same for each profile; wherein the electromechanical device connects the external power supply to the one or more loads based on the output signals generated by the logic.

16. The power module of claim 1, further comprising a zero crossing detection circuit configured to receive AC power from the external power supply and generate a signal indicative of the zero crossing of the AC power.

17. An electric appliance comprising:

one or more loads;

at least one power module electrically coupled to the one or more loads, each of the at least one power module comprising:

a logic circuit configured to generate one or more control signals indicative of the power level to be applied from an external power supply coupled to the power module to the one or more loads;

an electromechanical device configured to electrically connect the external power supply to the one or more loads based on the one or more control signals from the logic circuit; a user-controlled circuit configured to provide a signal indicative of a power level to deliver to the one or more loads, the signal is based on input received from a user-controlled actuator configured to be placed in one of a plurality of positions corresponding to user-provided input; and a housing configured to receive the electromechanical device, wherein the logic circuit includes logic configured to generate the one or more control signals indicative of a duty cycle based on user-provided input, the logic including: an input to receive a profile selection signal; and a data memory for profiles, each profile defining an association between input signals and output signals, and in which the logic uses the profile selection signal to select one of the profiles, the input signals being the same for each profile; wherein the electromechanical device connects the external power supply to the one or more loads based on the output signals generated by the logic.

18. The electric appliance of claim 17, wherein the electromechanical device includes a relay.

19. The electric appliance of claim 18, wherein the relay comprises: a metal strip configured to be displaced from a first open position to a second closed position in which the external power source is electrically connected to the one or more loads; and a solenoid configured to cause the metal strip to be displaced from the first position to the second position when the solenoid is activated.

20. The electric appliance of claim 17, wherein the housing is constructed from electrically insulating materials.

21. The electric appliance of claim 17, wherein the user-controlled circuit includes a switch having a plurality of positions that are each associated with a different power setting to control the logic circuit.

22. The electric appliance of claim 17, further comprising the user-controlled actuator and including a shaft having one end coupled to the user-controlled circuit.

23. The electric appliance of claim 17, further comprising a DC power supply circuit configured to provide DC current to at least one of: the logic circuit, and the electromechanical device.

24. The electric appliance of claim 23, wherein the DC power supply circuit is a non-transformer based power supply circuit.

25. The electric appliance of claim 24, wherein the non-transformer based DC power supply circuit includes at least one of a diode, a capacitor, and a resistor.

26. The electric appliance of claim 17, wherein one of the at least one power module is connected to apply power to at least two loads.

27. The electric appliance of claim 26, wherein the one of the at least one power module is configured to control the power applied by the power supply circuit to the at least two loads independently.

28. The electric appliance of claim 17, wherein each position of the user-controlled circuit is associated with a corresponding duty cycle, each corresponding duty cycle causing the electromechanical device to apply power for a duration determined by the corresponding duty cycle.

29. The electric appliance of claim 17, wherein the electric appliance is a cooking range top, and wherein each of the one or more loads is a heating element.

30. The electric appliance of claim 17, wherein the electric appliance is a heating device that includes at least one of warming displays cases, ovens, and warming cartridges, and wherein each of the one or more loads is a heating element.

* * * * *

UNITED STATES PATENT AND TRADEMARK OFFICE

CERTIFICATE OF CORRECTION

PATENT NO. : 7,420,142 B2
APPLICATION NO. : 11/548396
DATED : September 2, 2008
INVENTOR(S) : Barrena et al.

It is certified that error appears in the above-identified patent and that said Letters Patent is hereby corrected as shown below:

Col. 7, Line 26 Replace "216*a* and 216*a*" with --216*a* and 216*b*--.

Signed and Sealed this

First Day of December, 2009

David J. Kappos

David J. Kappos
*Director of the United States Patent and Trademark Office*